United States Patent [19]

Gaskell

[11] Patent Number: 4,583,687

[45] Date of Patent: Apr. 22, 1986

[54] FUEL INJECTION NOZZLE

[75] Inventor: David J. Gaskell, Upper Stanstead, England

[73] Assignee: Lucas Industries public limited company, Birmingham, England

[21] Appl. No.: 617,378

[22] Filed: Jun. 5, 1984

[30] Foreign Application Priority Data

Jul. 9, 1983 [GB] United Kingdom ..... 8318634

[51] Int. Cl.[4] ..... B05B 15/02; F02M 61/06

[52] U.S. Cl. ..... 239/118; 239/452; 239/459; 239/533.12

[58] Field of Search ..... 239/533.3–533.12, 239/117, 118, 452, 453, 459

[56] References Cited

U.S. PATENT DOCUMENTS

| | | | |
|---|---|---|---|
| 2,470,717 | 5/1949 | Palumbo | 239/533.8 |
| 2,595,639 | 5/1952 | Chmura et al. | 239/533.3 |
| 3,111,271 | 11/1963 | Åke Löfgren | 239/117 |

FOREIGN PATENT DOCUMENTS

| | | | |
|---|---|---|---|
| 21620 | 4/1956 | Fed. Rep. of Germany | 239/453 |
| 537892 | 7/1941 | United Kingdom | 239/117 |
| 812037 | 4/1959 | United Kingdom | 239/533.3 |

*Primary Examiner*—Jeffrey V. Nase
*Assistant Examiner*—Michael J. Forman

[57] ABSTRACT

A fuel injection nozzle has a valve member which is axially movable within a bore in a nozzle body. It is resiliently urged into contact with a seating at one end of the bore and carries an extension which projects with clearance through an opening at said one end of the bore. Intermediate the ends of the bore is an enlargement to which fuel under pressure can be supplied and the portions of the bore between the enlargement and the other end of the bore tapers inwardly from the enlargement to allow the extension to partake of sideways movement within the opening to minimize the risk of carbon deposit forming in the opening and on the extension.

2 Claims, 1 Drawing Figure

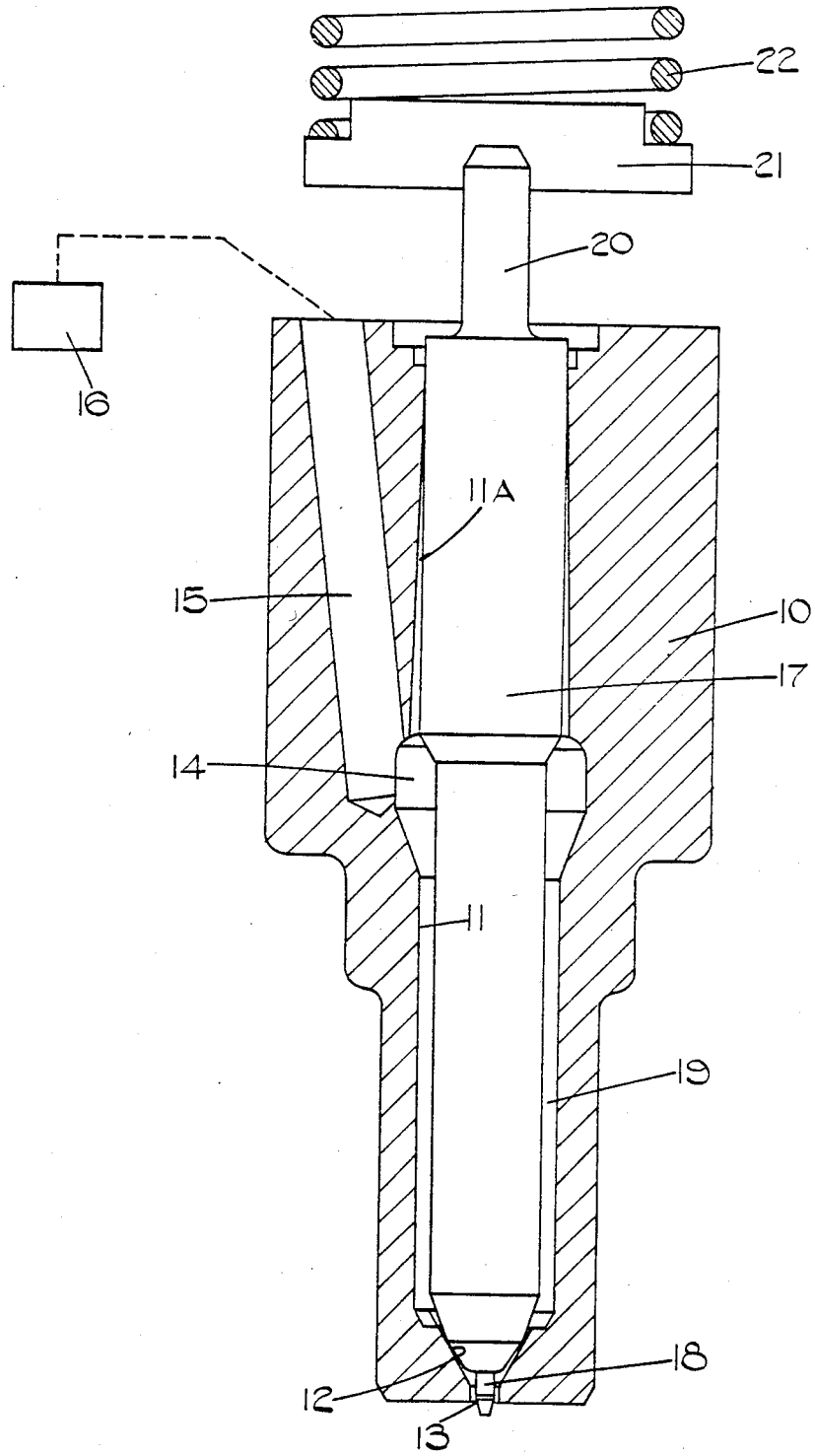
22
21
20
16
11A
15
10
17
14
11
19
18
12
13

FUEL INJECTION NOZZLE

This invention relates to fuel injection nozzles of the kind comprising a nozzle body, a blind bore formed in the body, a seating defined about an outlet opening into the blind end of the bore, a valve member slidable in the bore, one end of the valve member being shaped to co-operate with said seating, said one end of the valve member being provided with an extension which extends with clearance through said outlet opening, the valve member and bore over substantially half the length of the valve defining a clearance along which in use, fuel can flow from a fuel inlet through said opening, said extension as the valve member is lifted from the seating controlling fuel flow through the opening.

Such nozzles are known in the art as "pintle" nozzles and have particular application in certain types of engine. The extension by suitable shaping can be used to modify the profile of the fuel spray issuing through the outlet opening and can also be used to modify the rate of fuel delivery. Unfortunately due to the heat in the combustion chamber, carbon deposits tend to build up on the wall of the opening and such deposits impair the operation of the nozzle. The rate of deposit is to some extent dependent upon the quality of the fuel and with the prospect of having to use poorer quality fuels in the future, it can be expected that the problems of carbon deposit will become more severe.

The object of the present invention is to provide a nozzle of the kind specified in which the risk of carbon deposit is minimised.

According to the invention the portion of the bore and the portion of the valve member which do not define said clearance, are constructed so as to allow sideways movement of the extension within said opening.

An example of a fuel injection nozzle in accordance with the invention will now be described with reference to the accompanying drawing which shows the nozzle in sectional side elevation.

Referring to the drawing the nozzle comprises a body 10 of stepped form the narrower end of the body in use being exposed within a combustion space of an associated engine. The nozzle body in practice, is secured to a support member or holder by a cap nut. Formed within the body is a blind bore 11 and this extends from the wider end of the body to adjacent the narrower end thereof. At the blind end of the bore there is a defined a seating 12 about an outlet opening 13 and intermediate the ends of the bore the latter is provided with an enlargement 14 which communicates with a fuel inlet conveniently formed in the aforesaid holder, by way of inlet passage 15. The passage 15 in use is connected to the outlet of a fuel injection pump 16. Located within the bore is a valve member 17 and at its end adjacent the seating, the valve member is shaped to co-operate with the seating 12. Moreover, the valve member mounts an extension 18 which projects with clearance through the outlet opening 13.

The portion of the valve member which is disposed between the enlargment and the blind end of the bore is of reduced diameter to define an annular clearance 19 which communicates with the enlargement 14 and hence with the inlet passage 15.

The valve member at its end remote from the seating, defines a peg 20 which carries a spring abutment 21 the latter being engaged by a coiled compression spring 22.

Conveniently the spring is mounted within a vented chamber defined in the aforesaid holder or supporting body.

In operation, when fuel under pressure is supplied to the enlargement 14 from the fuel pump 16, the fuel pressure acting on the differential area of the valve member creates a force acting to move the valve member against the action of the spring 22. When the force exerted by the spring is overcome, the valve member is lifted from its seating to allow fuel flow through the annular clearance defined between the extension and the wall of the opening 13. The extension is profiled to control the fuel flow through the opening and may be profiled to alter the shape of the fuel spray issuing from the opening and/or the rate at which fuel can flow through the opening.

As mentioned above since the narrower end portion of the nozzle body is exposed to the combustion chamber it becomes heated by the combustion process and fuel tends to carbonise on the wall of the opening 13 and also the extension 18 and the downstream portion of the seating 12. The deposit of carbon can build up to the extent that the operation of the nozzle is impaired. In order to minimise the tendency for carbon deposit to form, the portion of the bore 11 which lies between the enlargement 14 and the wider end of the body and which is referenced 11A, together with the portion of the valve member 17 within that portion of the bore, are shaped to permit sideways movement of the extension 18 within the opening 13. It is found that this substantially reduces the risk of carbon deposit being formed on those parts. The sideways movement of the valve member is achieved by arranging that the portion 11A of the bore tapers inwardly from the enlargement 14. The associated portion of the valve member 17 is of right cylindrical form and this means that in use, the valve member will tend to rock about the end portion of the bore 11A removed from the enlargement 14. The radial clearance between the bore 11A and the valve member at the end adjacent the enlargement is in the particular example, 0.003 mm and at the opposite end of the portion 11A, 0.001 mm.

The sideways movement results in mechanical removal of the deposit as it is formed, but should not be such that metal to metal contact of the extension and the wall of the outlet opening could take place.

I claim:

1. A fuel injection nozzle for supplying fuel to a combustion space of an internal combustion engine, comprising a nozzle body, a blind bore formed in the body, said blind bore having a blind end, a seating defined about an outlet opening extending from the blind end of the bore, a valve member slidable in the bore, one end of the valve member being shaped for cooperation with the seating, an extension at the one end of the valve member, said extension extending with clearance through said outlet opening, a coiled compression spring action on an other end of the valve member to urge the valve member into contact with the seating, the valve member and bore over substantially half the length of the valve member from said one end thereof defining a clearance, the valve member having a portion extending from the other end thereof to said clearance, a fuel inlet passage in the body, said fuel inlet passage communicating at one end with said clearance and at its other end in use with a high pressure fuel pump, characterized in that the portion of the valve member extending from the other end thereof to said clearance is of right cylindrical form, and the portion of the bore in which said portion of the valve member is located tapers inwardly in the direction away from the seating to a position closely adjacent said portion of the valve member whereby in use, the extension can partake of sideways movement in said outlet opening.

2. A nozzle according to claim 1 in which the radial clearance between the bore and said valve member at the wider end of said portion of the bore is 0.003 mm and at the narrower end of the bore 0.001 mm.

* * * * *